US009327383B1

(12) United States Patent
Chuang

(10) Patent No.: US 9,327,383 B1
(45) Date of Patent: May 3, 2016

(54) QUICK REPLACEMENT DEVICE OF ABRASIVE BELT WHEEL

(71) Applicant: Bor-Yann Chuang, Taichung (TW)

(72) Inventor: Bor-Yann Chuang, Taichung (TW)

( * ) Notice: Subject to any disclaimer, the term of this patent is extended or adjusted under 35 U.S.C. 154(b) by 0 days.

(21) Appl. No.: 14/622,652

(22) Filed: Feb. 13, 2015

(51) Int. Cl.
*B24B 45/00* (2006.01)
*B24B 41/02* (2006.01)
*B24B 21/00* (2006.01)

(52) U.S. Cl.
CPC ..... *B24B 41/02* (2013.01); *B24B 21/00* (2013.01)

(58) Field of Classification Search
CPC ..... B24B 45/00; B24B 7/12; B24B 41/02; B24B 21/00
USPC ..... 451/184, 188, 296, 182, 178, 340
See application file for complete search history.

(56) References Cited

U.S. PATENT DOCUMENTS 1,929,101 A * 10/1933 Schulte ..... B24B 7/12 451/131
1,983,585 A * 12/1934 Van Valkenburgh ..... C14B 1/46 451/188
5,842,913 A * 12/1998 Nemazi ..... B24B 7/28 451/496
6,146,254 A * 11/2000 Wang ..... B24B 7/12 451/188
8,287,335 B2 * 10/2012 Chang ..... B24B 7/075 451/11
2003/0104772 A1 * 6/2003 Chuang ..... B24B 21/02 451/155
2003/0190876 A1 * 10/2003 Raffo, Sr. ..... B24B 7/12 451/182

* cited by examiner

*Primary Examiner* — Robert Rose
(74) *Attorney, Agent, or Firm* — Ming Chow; Sinorica, LLC

(57) ABSTRACT

A quick replacement device of an abrasive belt wheel is disposed on a belt sander. The belt sander has an abrasive belt wheel box. The abrasive belt wheel box is provided with two spaced fixing seats. Two ends of the abrasive belt wheel are provided with brackets relative to the fixing seats. The brackets and the fixing seats are fixed through fixing members. Through the fixing members, the abrasive belt wheel can be assembled to or disassembled from the abrasive belt wheel box quickly, providing a simple and quick replacement effect. The time to replace the abrasive belt wheel can be shortened so as to enhance work efficiency and economic efficiency.

6 Claims, 5 Drawing Sheets

QUICK REPLACEMENT DEVICE OF ABRASIVE BELT WHEEL

BACKGROUND OF THE INVENTION

1. Field of the Invention

The present invention relates to a quick replacement device of an abrasive belt wheel.

2. Description of the Prior Art

A belt sander is widely used, such as wooden products, furniture, and so on. The surface of wood has to be processed appropriately by sanding and polishing through the belt sander to enhance the overall appearance and fine modification. However, a conventional belt sander uses screw members to assemble or disassemble the parts of the belt sander. After a period of time, the belt sander suffers a lot of wear and tear. It is very complicated to replace the consumable and the parts. The operator may waste a lot of time. This influences the progress of the work and lowers the work efficiency greatly.

After a period of time for use, the abrasive belt wheel is worn by sanding, running of the parts for a long time, and other factors, which causes an eccentric displacement relative to the wheel axis when the abrasive belt wheel is running so the processing precision of the abrasive surface to contact with the workpiece is influenced. A normal adjustment way uses screw members to adjust the front and rear deflection of the wheel shaft of the abrasive belt wheel so as to adjust the front and rear displacement of the abrasive belt wheel, such that the eccentric displacement of the abrasive belt wheel can be adjusted.

Therefore, the replacement and adjustment of the abrasive belt wheel of the conventional belt sander often waste a lot of time in operation to lower work efficiency. These days, in the pursuit of an ideal and practical economy, it fails to meet the requirements of economic efficiency. Accordingly, the inventor of the present invention has devoted himself based on his many years of practical experiences to solve these problems.

SUMMARY OF THE INVENTION

The primary object of the present invention is to provide a quick replacement device of an abrasive belt wheel for the operator to replace and adjust the abrasive belt wheel quickly so as to enhance work efficiency and economic efficiency.

In order to achieve the aforesaid object, the quick replacement device of the abrasive belt wheel is disposed on a belt sander. The belt sander has an abrasive belt wheel box. The abrasive belt wheel is mounted in the abrasive belt wheel box. The abrasive belt wheel is connected with an output shaft of a motor through a coupling. The abrasive belt wheel box has a circumferential wall. The abrasive belt wheel box comprises two fixing seats spaced along a long axis thereof. The fixing seats are perpendicular to the long axis of the abrasive belt wheel box and integral with the circumferential wall. A first space, a second space, and a third space are defined within the circumferential wall of the abrasive belt wheel box. The fixing seats each have a receiving trough. The fixing seats each have longitudinal support seats at two opposing sides of the receiving trough. The support seats each have a longitudinal first through hole. Two ends of the abrasive belt wheel are provided with brackets relative to the fixing seats. The brackets each have two protruding portions relative to the support seats. The protruding portions each have a longitudinal second through hole. A plurality of fixing members each is inserted in the first through hole and the second through hole for the brackets to be fixed to the fixing seats. The abrasive belt wheel is disposed in the second space. The coupling and the output shaft of the motor are disposed in the first space.

Through the fixing members, the abrasive belt wheel can be assembled to or disassembled from the abrasive belt wheel box quickly, providing a simple and quick replacement effect. The time to replace the abrasive belt wheel can be shortened so as to enhance work efficiency and economic efficiency.

DETAILED DESCRIPTION OF THE PREFERRED EMBODIMENTS

Embodiments of the present invention will now be described, by way of example only, with reference to the accompanying drawings.

Figure 1:
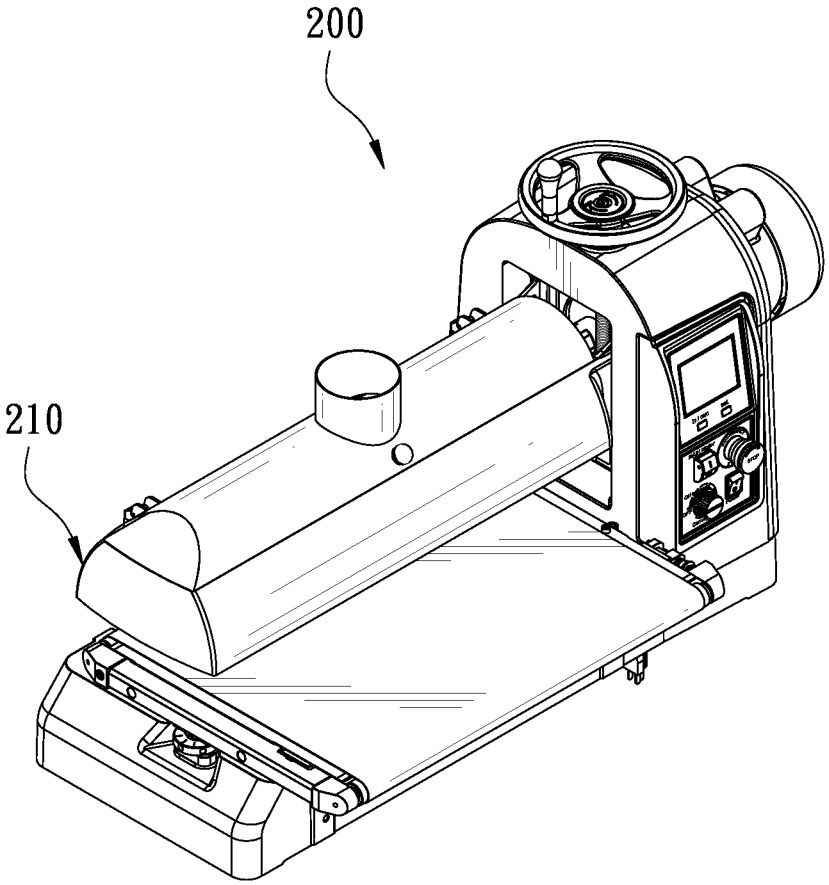
FIG. 1 is a perspective view of the present invention.
Figure 2:
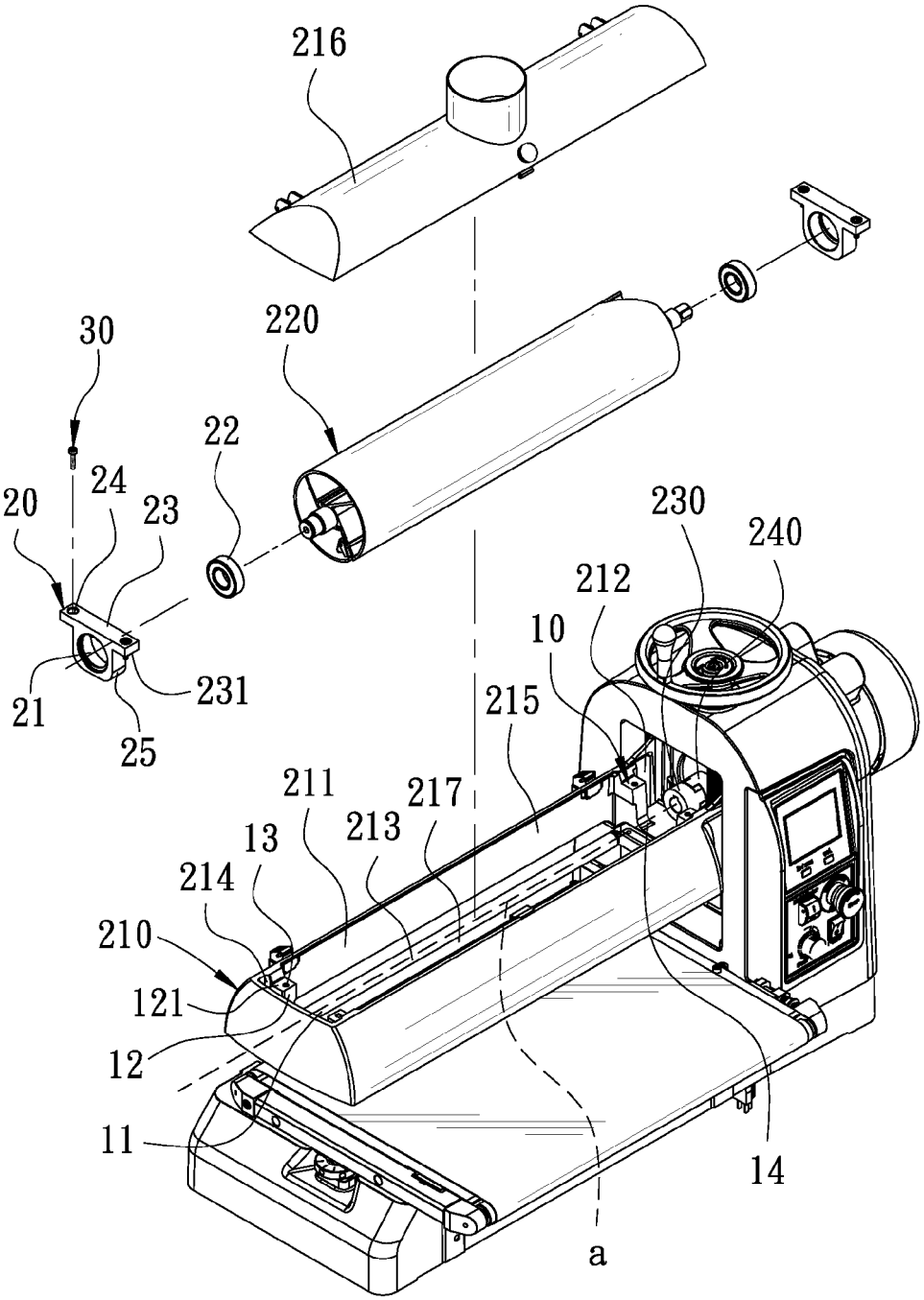
FIG. 2 is an exploded view of the present invention.
Figure 3:
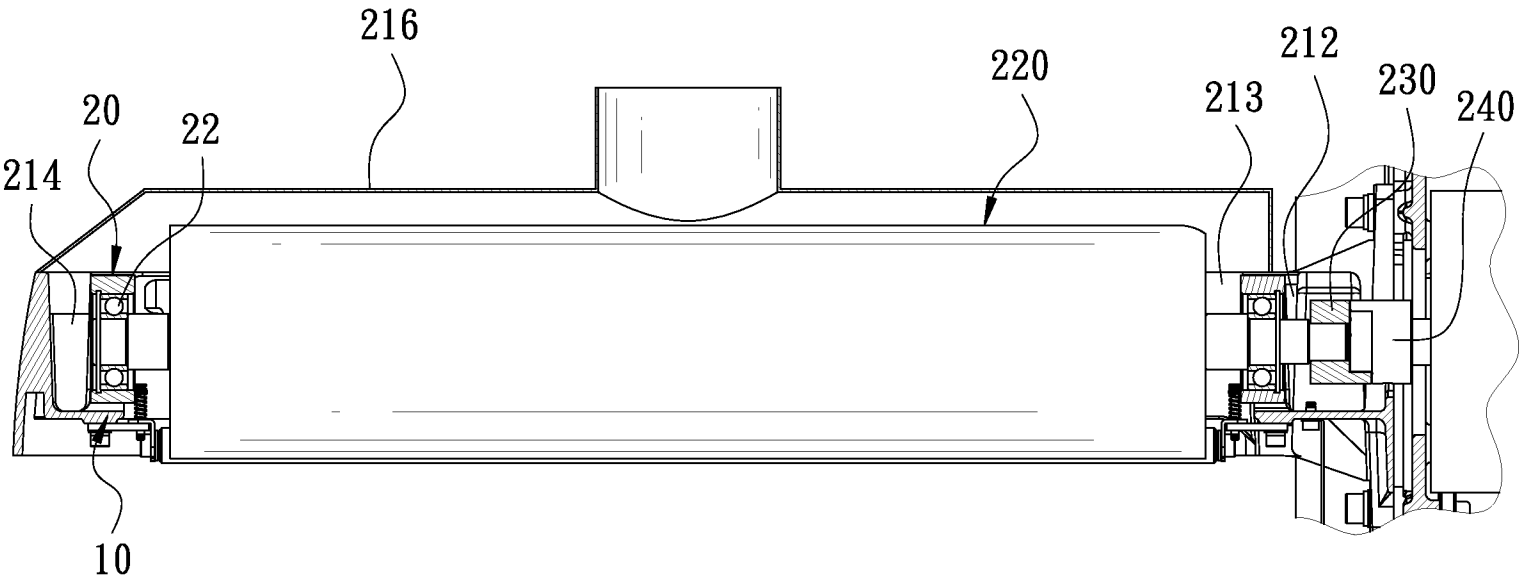
FIG. 3 is a sectional view of the present invention.

FIG. 1 is a perspective view of the present invention. FIG. 2 is an exploded view of the present invention. FIG. 3 is a sectional view of the present invention. The present invention discloses a quick replacement device of an abrasive belt wheel. The quick replacement device is disposed on a belt sander 200. The belt sander 200 has an abrasive belt wheel box 210. An abrasive belt wheel 220 is provided in the abrasive belt wheel box 210. The abrasive belt wheel 220 is connected with an output shaft 240 of a motor through a coupling 230.

The abrasive belt wheel box 210 has a circumferential wall 211. The abrasive belt wheel box 210 comprises two fixing seats 10 spaced along a long axis a thereof. The fixing seats 10 are perpendicular to the long axis a of the abrasive belt wheel box 210 and integral with the circumferential wall 211, such that a first space 212, a second space 213, and a third space 214 are defined within the circumferential wall 211 of the abrasive belt wheel box 210. The abrasive belt wheel box 210 has a first opening 215 at the top end of the circumferential wall 211. The first opening 215 communicates with the first space 212, the second space 213, and the third space 214. The abrasive belt wheel box 210 is provided with a cover 216 to cover the first opening 215. The abrasive belt wheel box 210 has a second opening 217 at the bottom end of the circumferential wall 211. The second opening 217 communicates with the second space 213. The fixing seats 10 each have a receiving trough 11. The fixing seats 10 each have longitudinal support seats 12 at two opposing sides of the receiving trough 11. The support seats 12 of the fixing seats 10 each have a support plane 121. The support seats 12 each have a longitudinal first through hole 13. A second tightening member 14 is provided between the support seats 12 of each fixing seat 10. The second tightening member 14 is a curved trough.

Two ends of the abrasive belt wheel 220 are provided with brackets 20 relative to the fixing seats 10. The brackets 20 each have a through hole 21. The through hole 21 of each bracket 20 is provided with a bearing 22. The bearing 22 is pivotally connected with the abrasive belt wheel 220. The brackets 20 each have two protruding portions 23 relative to the support seats 12. The protruding portions 23 each have an engaging plane 231 corresponding to the support plane 121.

The protruding portions 23 each have a longitudinal second through hole 24. Two bottom corners of the brackets 25 each have a first tightening member 25 corresponding to the second tightening member 14. The first tightening member 25 is a rounded corner.

A plurality of fixing members 30 each is inserted in the first through hole 13 and the second through hole 24 for the brackets 20 to be fixed to the fixing seats 10. The abrasive belt wheel 220 is disposed in the second space 213. The coupling 230 and the output shaft 240 of the motor are disposed in the first space 212.

Figure 4:
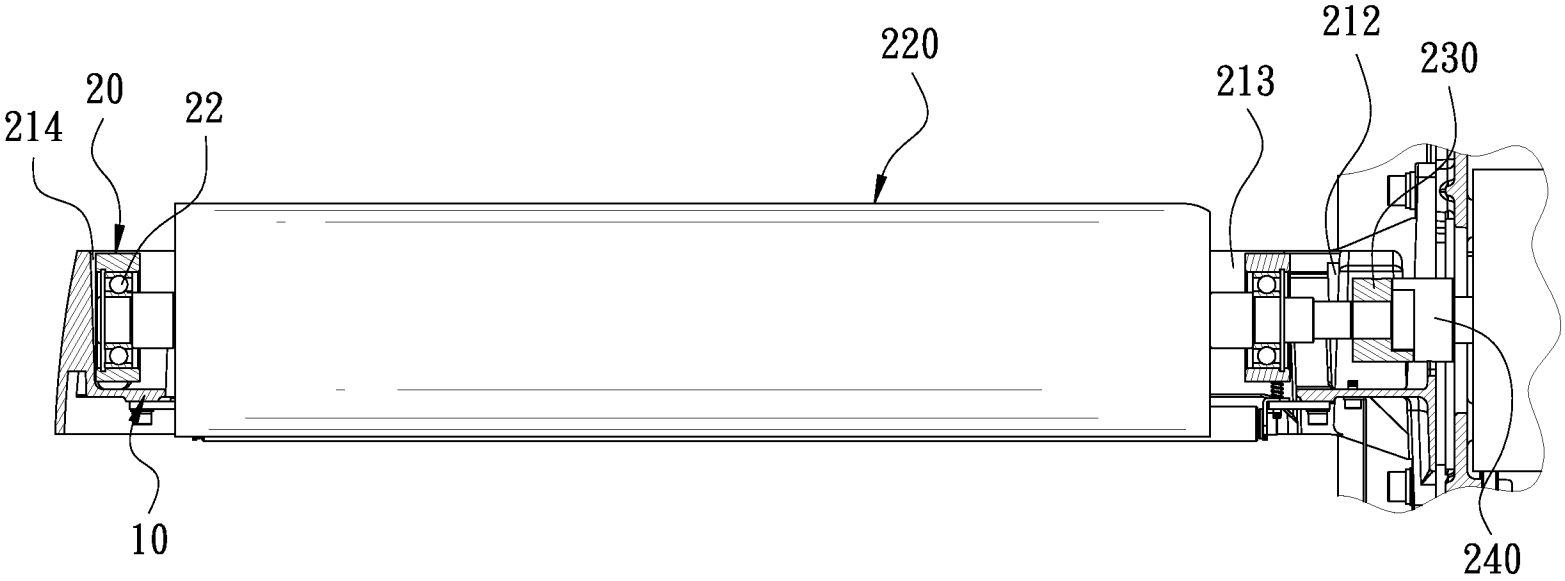
FIG. 4 is a schematic view of the present invention when in use, showing connection/disconnection of the abrasive belt wheel and the coupling.
Figure 5:
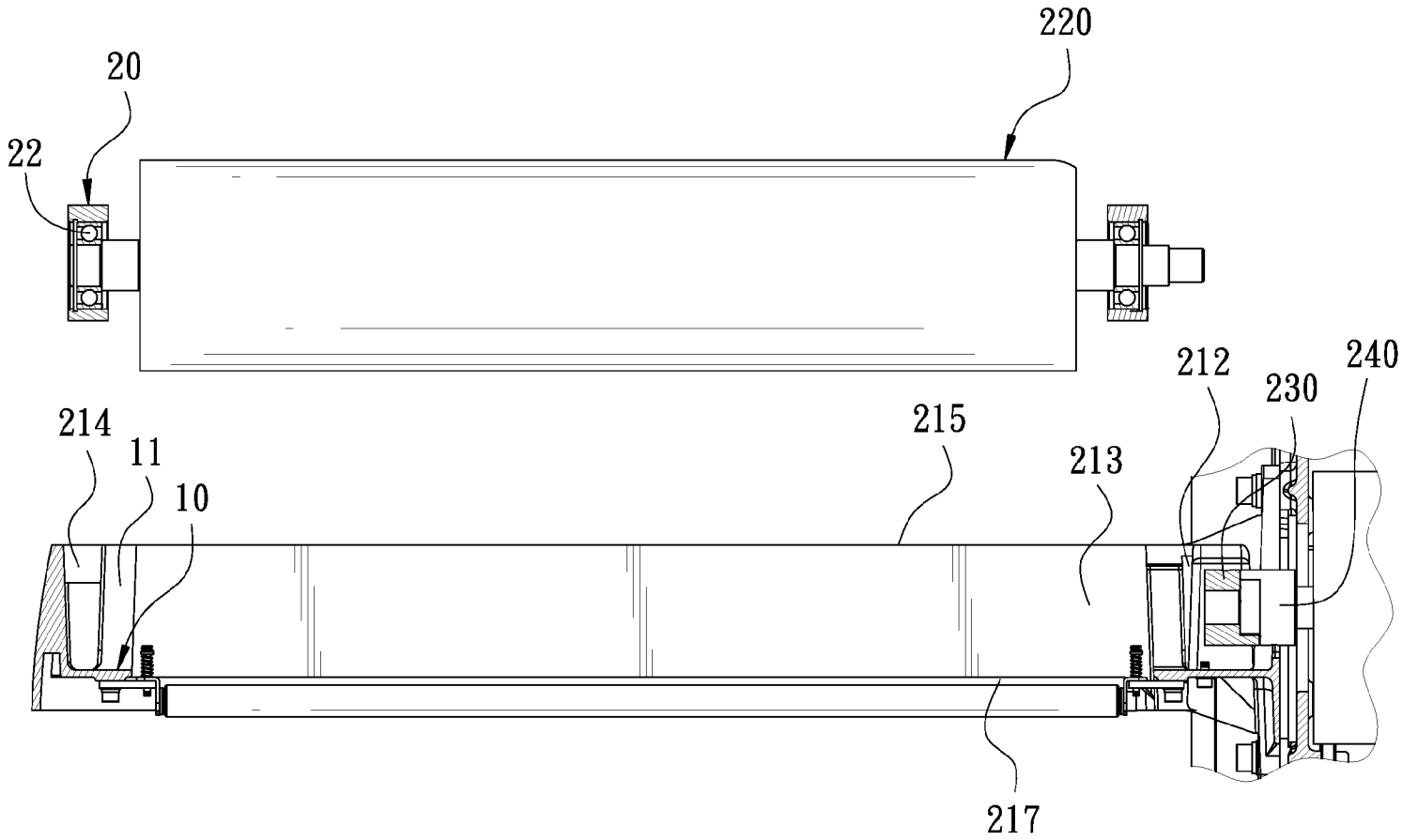
FIG. 5 is a schematic view of the present invention when in use, showing the abrasive belt assembled to/disassembled from the abrasive belt wheel box.

FIG. 4 and FIG. 5 are schematic views of the present invention when in use. When the operator wants to replace the abrasive belt wheel 220, the fixing members 30 are disassembled from the fixing seats 10, namely, the brackets 20 are disassembled from the fixing seats 10 so that the abrasive belt wheel 220 is disengaged from the coupling 230. The abrasive belt wheel 220 can be transversely moved toward the third space 214 for the abrasive belt wheel 220 to disengage from the coupling 230. After that, the abrasive belt wheel 220 can be taken out upward from the first opening 215.

Mounting a new abrasive belt wheel 220 is operated reversely. The new abrasive belt wheel 220 is placed into the abrasive belt wheel box 210 through the first opening 215 for the abrasive belt wheel 220 to be placed in the second space 213 and the third space 214, and then the abrasive belt wheel 220 is transversely moved toward the second space 213 for the brackets 20 to be engaged in the fixing seats 10. The brackets 20 correspond to the receiving troughs 11 of the fixing seats 10. The brackets 20 and the fixing seats 10 have the first tightening members 25 and the second tightening members 14, respectively, so the brackets 20 can be engaged and located in the receiving troughs 11 of the fixing seats 10. Furthermore, the support planes 121 of the support seats 12 of the fixing seats 10 hold against the engaging planes 231 of the protruding portions 23 of the brackets 20. In this way, the position and level of the abrasive belt wheel 220 can be assured when the abrasive belt wheel 220 is replaced. There is no need to adjust the position and level of the abrasive belt wheel 220 so as to shorten the time to replace the abrasive belt wheel 220. After the brackets 20 are engaged with the fixing seats 10, the abrasive belt wheel 220 can be positioned to connect with the coupling 230. The output shaft 240 of the motor brings the abrasive belt wheel 220 to rotate through the coupling 230. The brackets 20 are secured to the fixing seats 10 by the fixing members 30. The replacement of the abrasive belt wheel 220 is completed.

It is noted that through the fixing members 30 the brackets 20 can be secured to the fixing seats 10 easily. Thus, when the operator wants to replace the abrasive belt wheel 220, the fixing members 30 are disassembled from the fixing seats 10, namely, the brackets 20 are disassembled from the fixing seats 10 so that the abrasive belt wheel 220 is disengaged from the coupling 230. The abrasive belt wheel 220 can be assembled to or disassembled from the abrasive belt wheel box 210 quickly, providing a simple and quick replacement effect. The time to replace the abrasive belt wheel 220 can be shortened so as to enhance work efficiency and economic efficiency.

Besides, the first opening 215 communicates with the first space 212, the second space 213, and the third space 214. Through the first opening 215, the operator can replace the abrasive belt wheel 220 quickly. The second opening 217 only communicates with the second space 213. When the abrasive belt wheel 220 is running in the second space 213, the second opening 217 enhances the dust-collection effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick replacement device of an abrasive belt wheel, disposed on a belt sander, the belt sander having an abrasive belt wheel box, the abrasive belt wheel being mounted in the abrasive belt wheel box, the abrasive belt wheel being connected with an output shaft of a motor through a coupling, characterized by:

the abrasive belt wheel box having a circumferential wall, the abrasive belt wheel box comprising two fixing seats spaced along a long axis thereof, the fixing seats being perpendicular to the long axis of the abrasive belt wheel box and integral with the circumferential wall, a first space, a second space, and a third space being defined within the circumferential wall of the abrasive belt wheel box, the fixing seats each having a receiving trough, the fixing seats each having longitudinal support seats at two opposing sides of the receiving trough, the support seats each having a longitudinal first through hole;

two ends of the abrasive belt wheel being provided with brackets relative to the fixing seats, the brackets each having two protruding portions relative to the support seats, the protruding portions each having a longitudinal second through hole;

a plurality of fixing members each being inserted in the first through hole and the second through hole for the brackets to be fixed to the fixing seats, the abrasive belt wheel being disposed in the second space, the coupling and the output shaft of the motor being disposed in the first space.

2. A quick replacement device of an abrasive belt wheel as claimed in claim 1, wherein two bottom corners of the brackets each have a first tightening member, and a second tightening member is provided between the support seats of each fixing seat, corresponding to the first tightening member.

3. A quick replacement device of an abrasive belt wheel as claimed in claim 2, wherein the first tightening member is a rounded corner, and the second tightening member is a curved trough.

4. A quick replacement device of an abrasive belt wheel as claimed in claim 1, wherein the support seats of the fixing seats each have a support plane, and the protruding portions each have an engaging plane corresponding to the support plane.

5. A quick replacement device of an abrasive belt wheel as claimed in claim 1, wherein the brackets each have a through hole, the through hole of each bracket is provided with a bearing, and the bearing is pivotally connected with the abrasive belt wheel.

6. A quick replacement device of an abrasive belt wheel as claimed in claim 1, wherein the abrasive belt wheel box has a first opening at a top end of the circumferential wall, the first opening communicates with the first space, the second space, and the third space, the abrasive belt wheel box is provided with a cover to cover the first opening, the abrasive belt wheel box has a second opening at a bottom end of the circumferential wall, and the second opening communicates with the second space.

* * * * *